US011002506B2

(12) United States Patent
Rentz

(10) Patent No.: US 11,002,506 B2
(45) Date of Patent: May 11, 2021

(54) ARCHERY FINGER TAB

(71) Applicant: Gregory E. Summers, Madison Heights, VA (US)

(72) Inventor: Marc Rentz, Madison Heights, VA (US)

(73) Assignee: Gregory E. Summers, Madison Heights, VA (US)

( * ) Notice: Subject to any disclaimer, the term of this patent is extended or adjusted under 35 U.S.C. 154(b) by 42 days.

(21) Appl. No.: 16/385,467

(22) Filed: Apr. 16, 2019

(65) Prior Publication Data

US 2020/0333103 A1 Oct. 22, 2020

(51) Int. Cl.
*F41B 5/16* (2006.01)
*F41B 5/14* (2006.01)

(52) U.S. Cl.
CPC ..... *F41B 5/1473* (2013.01)

(58) Field of Classification Search
CPC ..... F41B 5/1469; F41B 5/1473
USPC ..... 124/35.2
See application file for complete search history.

(56) References Cited

U.S. PATENT DOCUMENTS 2,133,650 A * 10/1938 Baker ..... F41B 5/1473 124/35.2
2,277,893 A * 3/1942 Tweedie ..... F41B 5/1473 2/20
2,555,203 A * 5/1951 Ramsey ..... F41B 5/1473 219/211
2,834,018 A * 5/1958 Farmes ..... F41B 5/1473 2/21
2,929,372 A * 3/1960 Vance ..... F41B 5/1469 124/35.1
2,974,319 A * 3/1961 Wilson ..... F41B 5/1473 2/21
2,996,059 A * 8/1961 Vance ..... F41B 5/1473 124/35.2
2,999,243 A * 9/1961 Gross ..... F41B 5/1473 2/21
3,217,334 A * 11/1965 Albertelli ..... F41B 5/1473 2/21
3,224,009 A * 12/1965 Hoyt, Jr. ..... F41B 5/1473 2/21
3,229,304 A * 1/1966 Brooks ..... F41B 5/1473 2/21
3,246,338 A * 4/1966 Miller ..... F41B 5/1473 2/21
3,262,126 A * 7/1966 Price ..... F41B 5/1473 2/159
3,608,090 A * 9/1971 Wilson et al. ..... F41B 5/1473 2/21

(Continued)

*Primary Examiner* — Alexander R Niconovich
(74) *Attorney, Agent, or Firm* — Leading Edge Law Group, PLC

(57) ABSTRACT

An ergonomic finger tab includes a tab plate with a contoured upper surface to receive and support the fingers of an archer during execution of an archer shot. The upper surface contains a plurality of spaced parallel contours extending from the forward edge of the tab plate to a position short of the rear edge of the tab plate. A palm extender is adjustably connected with the tab plate adjacent to its rear edge. The palm extender preferably includes a pivotal palm plate which can be pivoted to provide a reference point for the archer when positioning the shooting hand on the finger tab.

19 Claims, 8 Drawing Sheets

(56) References Cited

U.S. PATENT DOCUMENTS 3,665,911 A * 5/1972 Altier ..... F41B 5/1473 124/23.1
3,768,456 A * 10/1973 Hansen ..... F41B 5/1469 124/35.2
3,818,888 A * 6/1974 Keeney ..... F41B 5/1469 124/35.2
3,845,504 A * 11/1974 Killian ..... F41B 5/1473 2/21
3,898,974 A * 8/1975 Keck ..... F41B 5/1469 124/35.2
4,097,931 A * 7/1978 Hirose ..... F41B 5/1473 2/21
4,132,215 A * 1/1979 Burton ..... F41B 5/1438 124/35.2
4,332,233 A * 6/1982 Knoble ..... F41B 5/1473 124/35.2
4,458,659 A * 7/1984 Troncoso, Jr. ..... F41B 5/1469 124/35.2
4,620,524 A * 11/1986 Saunders ..... F41B 5/1473 124/35.2
4,875,458 A * 10/1989 Young ..... F41B 5/1473 124/35.2
5,131,095 A * 7/1992 D'Amato ..... F41B 5/1473 2/21
5,261,581 A * 11/1993 Harden, Sr. ..... F41B 5/1469 124/23.1
5,323,754 A * 6/1994 Pittman ..... F41B 5/1469 124/35.1
5,333,595 A * 8/1994 Heffron ..... F41B 5/0031 124/23.1
5,617,838 A * 4/1997 Peruski ..... F41B 5/14 124/88
5,653,214 A * 8/1997 Lynn ..... F41B 5/1469 124/35.2
6,213,113 B1 * 4/2001 Groover ..... F41B 5/1469 124/35.2
9,074,836 B1 * 7/2015 Saunders ..... F41B 5/1469
9,393,479 B1 * 7/2016 Park ..... A63B 71/14
2005/0081838 A1 * 4/2005 Maki ..... F41B 5/1469 124/35.2
2010/0223710 A1 * 9/2010 Bell ..... F41B 5/1473 2/21
2013/0000007 A1 * 1/2013 Zumbo ..... F41B 5/1473 2/21
2015/0219418 A1 * 8/2015 Whalen ..... F41B 5/1469 124/35.2

* cited by examiner

ARCHERY FINGER TAB

BACKGROUND OF THE DISCLOSURE

When firing an archery shot, archers often use a finger tab to protect their fingers from damage from the string of a bow, particularly after repetitive shots. Repetitive shots may also damage the tendons in the archer's hands. Finger tabs help to alleviate pain and damage to the archer. Many archery instructors and coaches encourage their students to use finger tabs.

BRIEF DESCRIPTION OF THE PRIOR ART

Archery finger tabs are well known in the prior art. The first generation of finger tabs generally included one or more layers of leather with a central portion from which from which one or more finger portions extend. The back of the central portion includes a loop for receiving the middle finger of the archer's firing hand. Alternatively, the finger portions extend from a glove worn on the archer's firing hand. In many finger tabs, three finger portions extend parallel to the middle three fingers of the hand to wrap around the bow string while the archer draws the string to execute a shot.

The next generation of finger tabs included a rigid palm plate from which one or more strips of leather extend to protect the archer's fingers. The plate also includes a mechanism to connect the plate to one or more fingers of the archer.

While the prior finger tabs operate satisfactorily, they possess inherent drawbacks which limit the comfort of the tab and are not adaptable to different hand sizes or configurations or to different hand positions used by archers when executing a shot. The present invention was developed to provide an ergonomically designed finger tab which is adjustable and adaptable to meet all of an archer's needs while still providing maximum protection and comfort to the archer's fingers and tendons.

SUMMARY OF THE INVENTION

Accordingly, it is a primary object of the invention to provide an archery finger tab which includes an ergonomic tab plate having an upper surface containing spaced parallel contours for receiving the fingers of the pull hand of an archer to support the archer's palm and a portion of the archer's fingers during execution of an archery shot.

A palm extender is connected with the tab plate. Preferably, the palm extender is adjustably connected with the tab plate for longitudinal movement relative to the tab plate to accommodate the size of the archer's hand. In addition, the palm extender has two components joined by a hinge connection. A first component or fixture is adjustably connected with the tab plate and locked in place. A second component or member is connected with the fixture for pivotal movement about an axis which extends laterally with respect to the tab plate. The palm plate is able to swivel or pivot deep into the palm of the archer's hand until it is felt to provide the archer with accurate repetitive positioning of the finger tab within the archer's hand for each shot.

At least one layer of flexible material such as leather is connected with the tab plate and extends beyond an edge of the plate which contains the finger contours. The flexible material extends between the archer's fingers and the bow string.

A spacer is adjustably connected with the tab plate and extends upwardly from the tab plate upper surface between two contours within the surface.

A shelf is also connected with the tab plate and extends beneath the plate along an edge normal to the edge of the plate which contains the finger contours. The shelf defines a surface against which a thumb of the archer may rest during firing of a shot.

BRIEF DESCRIPTION OF THE FIGURES

Other objects and advantages of the invention will become apparent from a study of the following specification when viewed in the light of the accompanying drawing, in which.

DETAILED DESCRIPTION

Figure 2:
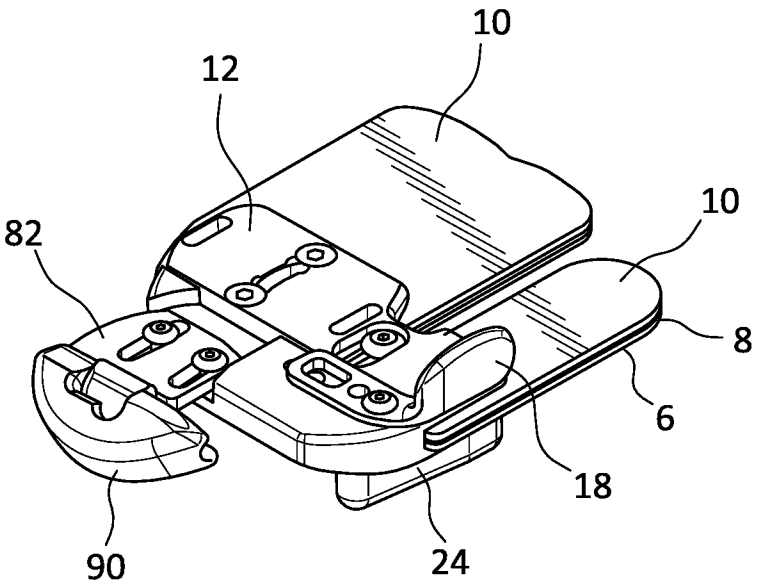
FIGS. 1 and 2 are rear top and bottom perspective views, respectively, of a first embodiment of an archery finger tab according to the invention.
Figure 1:
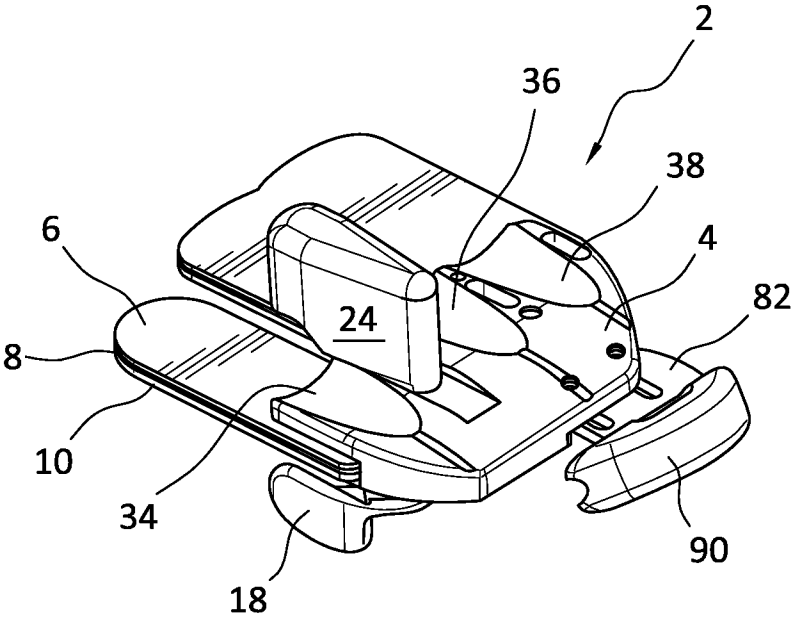
Figure 3:
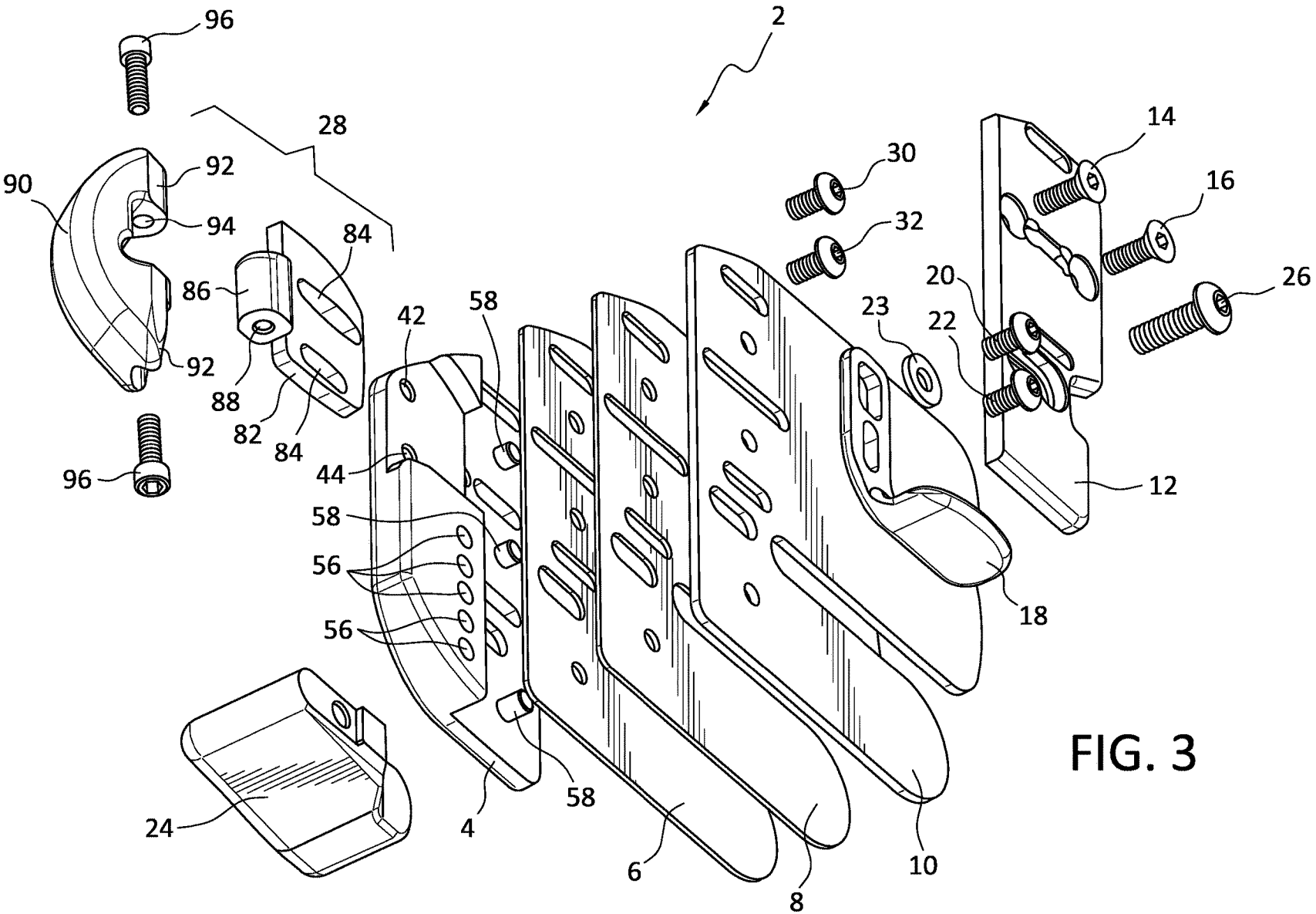
FIG. 3 is an exploded bottom perspective view of the finger tab of FIGS. 1 and 2.

Referring initially to FIGS. 1-3, an archery finger plate 2 according to the invention is shown. The finger plate includes a tab plate 4 and three tab layers 6, 8, 10 of flexible material which are clamped against the bottom surface of the tab plate by a clamp member or plate 12 using screws 14, 16 which pass through aligned openings in the clamp and in the layers of material and into threaded openings in the tab plate in a known manner.

While three layers of material are shown, it will be appreciated by those of ordinary skill in the art that any number of layers may be provided. According to a preferred embodiment, the top layer 6 is a layer of suede material, the middle layer 8 is formed of rubber, and the bottom layer 10 is formed of leather. The layers include extending portions which are adapted to be engaged by the fingers of an archer. More particularly, the fingers engage the top suede layer for comfort, the middle rubber layer provides support and cushioning, and the bottom leather layer is wrapped around a bow string to grip the string so that the archer may pull on the string in advance of an archery shot.

As will be developed in greater detail below, a shelf 18 is also connected with the bottom of the tab plate 4 using screws 20, 22 which pass through aligned openings in the shelf and layers of material into threaded openings in the bottom surface of the tab plate. A washer 23 is provided for the screw 20 that passes through the wider opening in the shelf to provide angular adjustment. A spacer 24 is connected with an upper surface of the tab plate using a screw 26 which passes through an opening in the plate and into a threaded opening in the spacer. A palm extender 28 is connected with the bottom surface of the tab plate using a pair of screws 30, 32 which pass through a portion of the plate into threaded openings in the tab plate bottom surface.

The tab plate 4 is shown in greater detail in FIGS. 4*a*-4*f*. It is preferably formed of a rigid material such as metal and molded into an ergonomic configuration. In a preferred embodiment, the tab plate is formed of brass for additional weight with a nickel plating. In another embodiment, the tab plate is formed of aluminum and painted or anodized in a selected color.

Figure 4F:
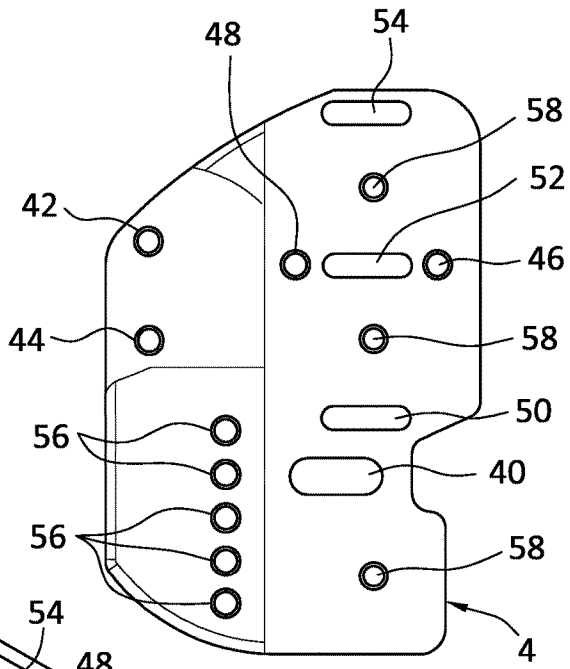
FIGS. 4*a*-4*f* are perspective, top, front, rear, side, and bottom plan views of the tab plate of the finger tab of FIGS. 1 and 2.
Figure 4A:
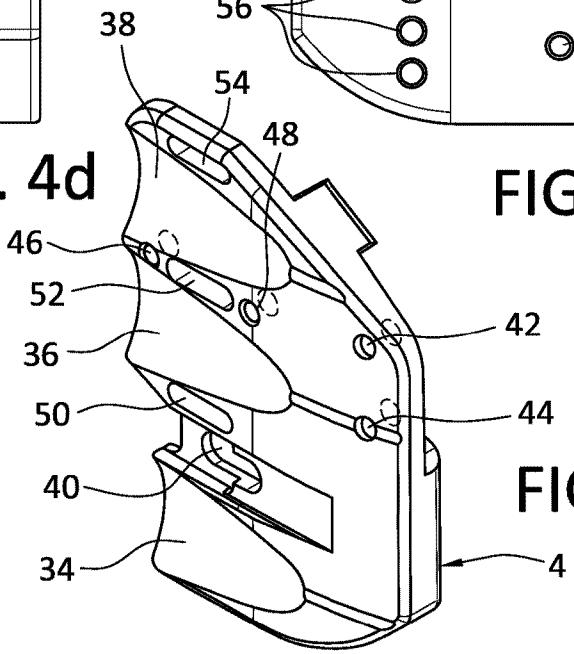
Figure 4D:
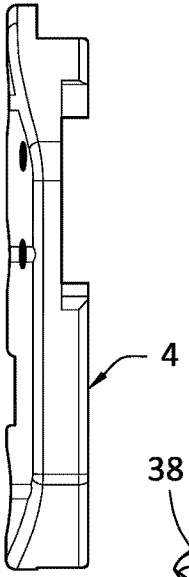
Figure 4B:
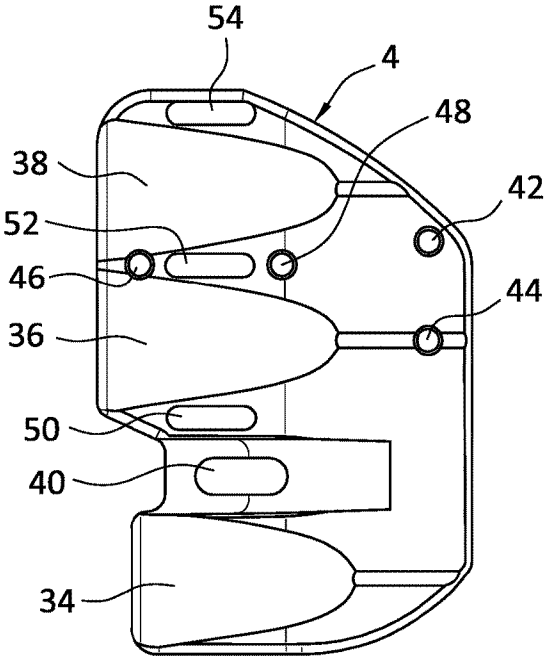
Figure 4E:
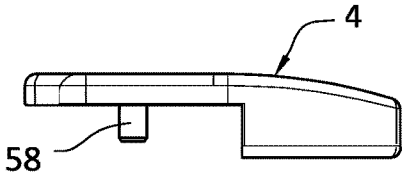
Figure 4C:
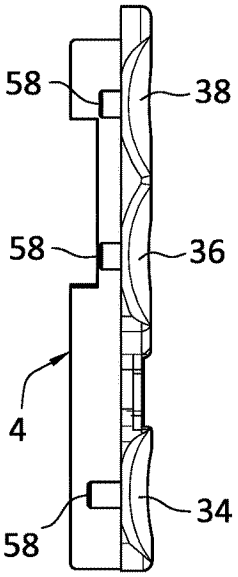

Referring to FIG. 4*b*, the upper surface of the tab plate 4 includes a plurality of spaced contours 34, 36, 38 extending longitudinally from a front edge of the plate toward a rear edge. In a lateral cross section, the contours have a concave configuration. The contours preferably terminate intermediate the forward and rear edges of the tab plate and are configured to receive the first, second and third fingers of the archer. Of course, other numbers of contours may be provided to accommodate greater or fewer fingers. The contours improve the comfort and feel of the finger tab.

The space between the first contour 34 and the second contour 36 is greater than the space between the second contour and the third contour to provide an area for the spacer 24. A longitudinally extending through slot 40 is arranged between the first and second contours to receive the fastening screw 26. Thus, with the screw 26 loosened slightly, the spacer can be adjusted forwardly and rearwardly relative to the tab plate as selected by the user. Tightening of the screw 26 secures the spacer in the selected position.

Threaded openings 42, 44 receive the screws 30, 32, respectively to connect the palm extender 28 with the tab plate. As will be developed below, the palm extender is also longitudinally adjustable relative to the tab plate.

Threaded openings 46, 48 in the tab plate receive the mounting screws 14, 16 which connect the clamp 12 with the tab plate. Spaced parallel through slots 50, 52, 54 are provided in the tab plate for receiving a strap, not shown. The strap is preferably in the form of an elastic band which passes through the slots adjacent to a finger of the archer. A round cord-lock (also not shown) can be provided on the strap which can be displaced on the band and cinched against the archer's finger to assist in retaining the finger tab assembly on the archer's hand.

Referring to FIG. 4*f*, the bottom surface of the tab plate 4 contains a plurality of spaced threaded openings 56 which extend laterally of the surface. These openings are adapted to receive the screws 20, 22 which connect the shelf 18 with the tab plate bottom surface. As will be readily apparent, the shelf is laterally and angularly adjustable relative to the tab plate depending on which threaded openings 56 are selected for receiving the screws 20, 22.

The bottom surface of the tab plate further includes a plurality of laterally spaced studs 58 extending therefrom. While three such studs are shown, they may vary in number. The studs are provided to assist with the connection of the layers of flexible material 6, 8, 10. More particularly, each layer contains spaced openings which are configured to receive the respective studs of the tab plate. The clamp 12 is configured to be positioned over the studs when it is connected with the tab plate. Thus, replacement of the material layers requires simply removing the screws 14, 16, and 26 and the clamp 12, lifting the layers of material off of the stud and replacing them with a different layer or layers, and then re-attaching the clamp 12 with the screws 14, 16, and 26.

Figure 5D:
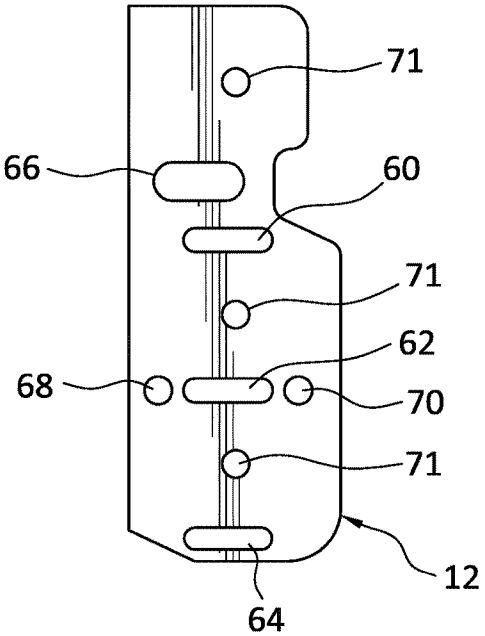
FIGS. 5*a*-5*d* are bottom perspective, bottom, right side, and top plan views, respectively, of the clamp of the finger tab of FIGS. 1 and 2.
Figure 5C:
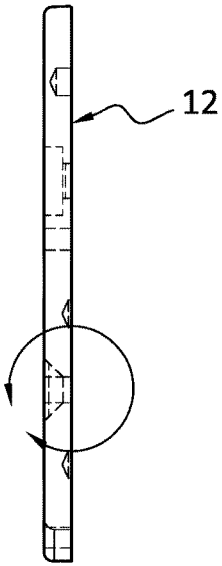
Figure 5A:
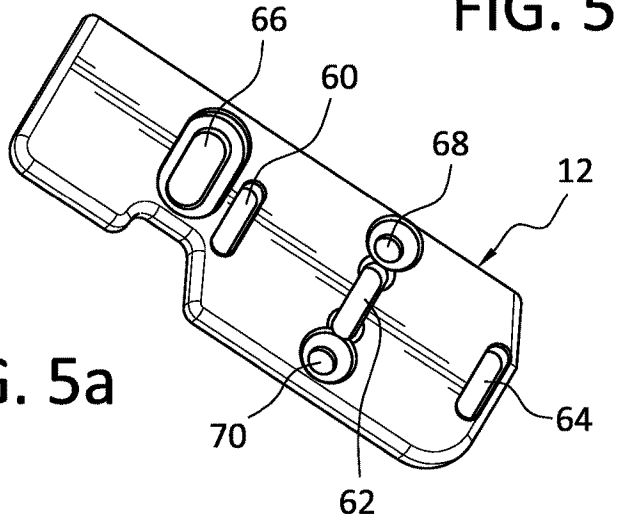
Figure 5B:
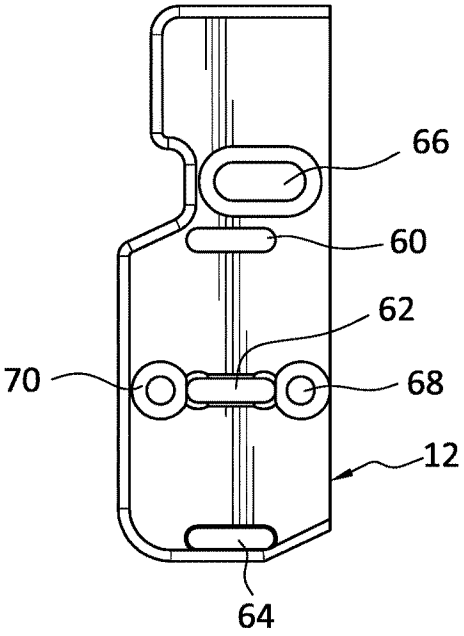
Figure 5E:
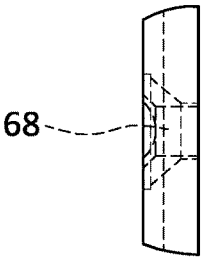
FIG. 5*e* is a detailed view of the clamp taken along line 5*e*-5*e* of FIG. 5*c;*
Figure 6E:
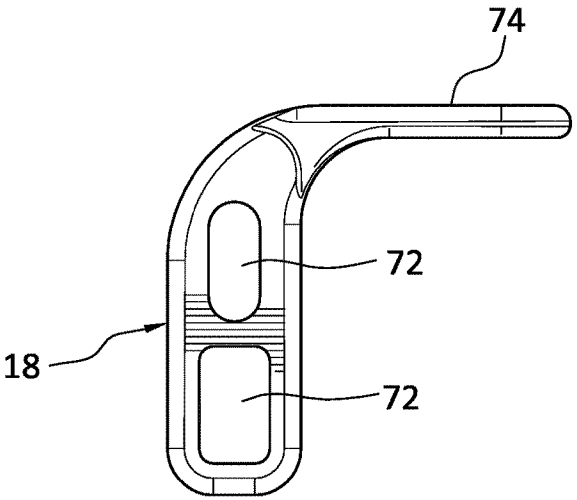
FIGS. 6*a*-6*f* are front top perspective, rear bottom perspective, front, right side, rear, and top plan views, respectively, of a shelf for the finger tab of FIGS. 1 and 2.
Figure 6B:
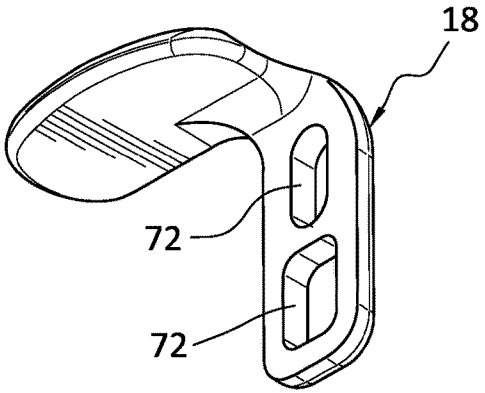
Figure 6D:
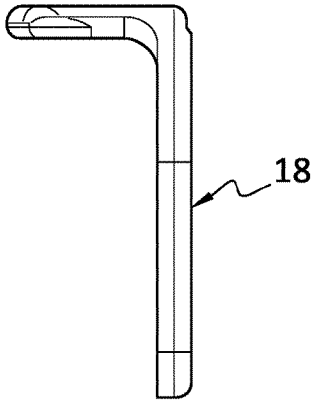
Figure 6A:
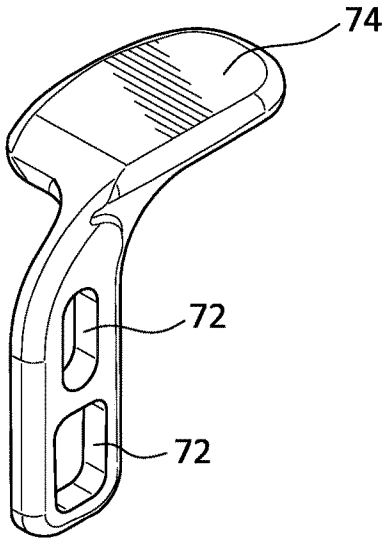
Figure 6C:
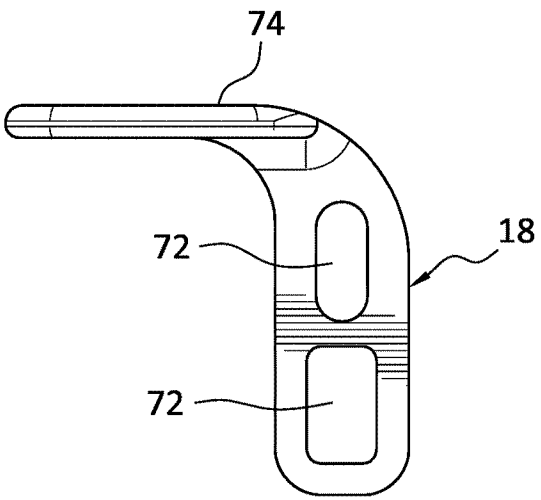
Figure 6F:
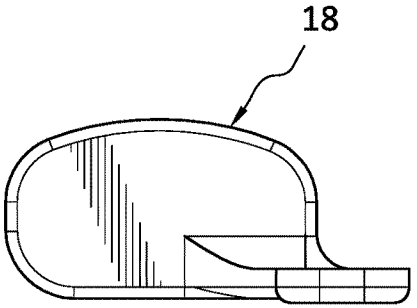
Figure 7B:
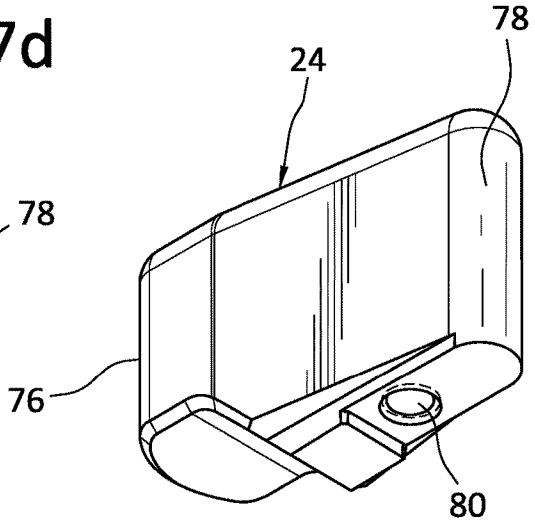
FIGS. 7*a*-7*e* are front top perspective, rear bottom perspective, front right side and bottom plan views of the spacer of the finger tab of FIGS. 1 and 2.
Figure 7D:
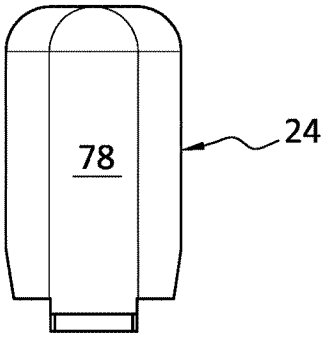
Figure 7A:
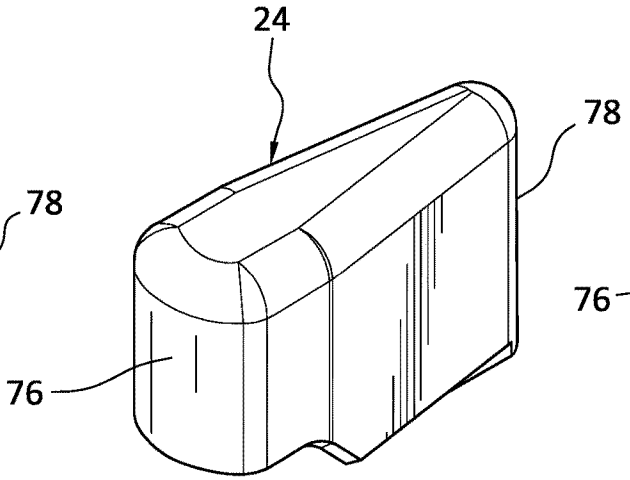
Figure 7C:
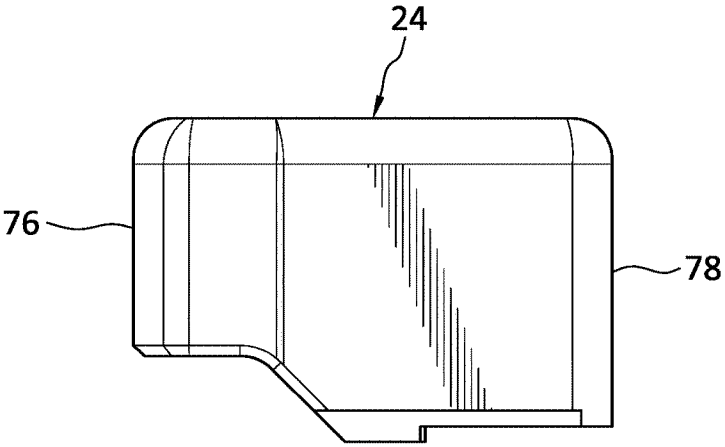
Figure 7E:
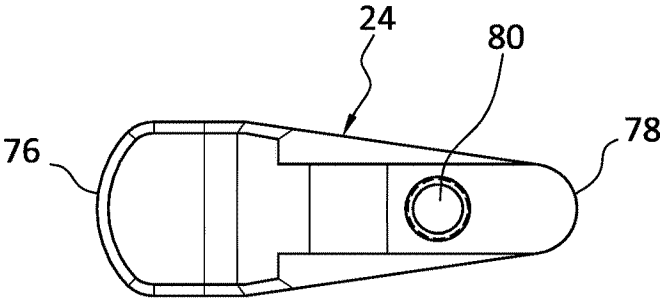

The clamp 12 is shown more particularly in FIGS. 5*a*-*fe*. It contains three through slots 60, 62, 64 which are configured to align with the through slots 50, 52, 54, respectively in the tab plate 4 to receive the strap (not shown) for connecting the finger tab with one or more fingers of the archer. The clamp further includes an elongated through slot 66 which receives the screw 26 for connecting the spacer with the tab plate. The slot has a chamfered edge which supports the head of the screw 26. Longitudinally spaced through openings 68, 70 having chamfered edges are provided to receive the screws 14, 16, respectively, which connect the clamp with the tab plate. As shown in FIG. 5*d*, the top surface of the clamp 12 contains three laterally spaced recesses 71 which are configured to receive the studs 58 extending from the bottom surface of the tab plate and hold the layers of material in place when the clamp is connected with the tab plate.

The shelf 18 is shown in detail in FIGS. 6*a*-6*f*. It has a generally L-shaped configuration including two leg portions. One leg portion contains a pair of elongate through openings 72 which receive the mounting screws 20, 22 for connecting the shelf with the tab plate. Owing to the elongated configuration of the openings 72, when the screws 20, 22 are loosened, the shelf may be moved laterally relative to the edge of the tab plate 4 as desired by the archer following which the screws are tightened to fasten the shelf in place. The other leg portion contains a wide surface 74 which is positioned generally parallel to and beneath a side edge of the tab plate as shown in FIGS. 1 and 2. The wide surface serves as a stop against which the thumb of the archer may abut during use of the finger tab. Lateral adjustment of the shelf allows it to be positioned for maximum comfort and operation by the archer.

FIGS. 7*a*-7*e* illustrate the spacer 24 of the finger tab. The spacer has a generally oblong configuration with convex front 76 and rear 78 surfaces. The bottom of the spacer is configured to mate with the region of the top surface of the tab plate 4 between the first 34 and second 36 contours above the slot 40. The spacer contains a threaded opening 80 in the bottom surface thereof which receives the screw 26 to connect the spacer with the top surface of the tab plate.

Figure 8C:
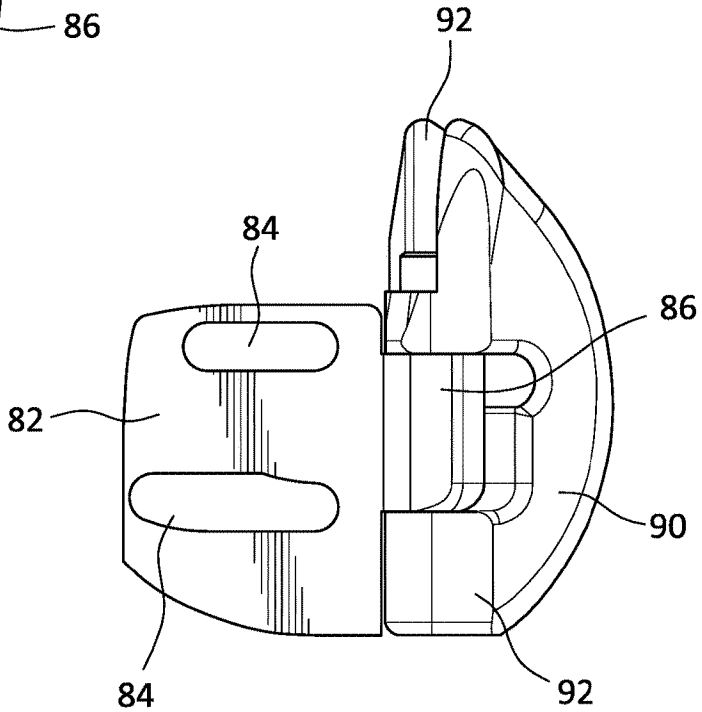
FIGS. 8*a*-8*c* are top perspective, bottom perspective, and top plan views, respectively, of a preferred embodiment of a palm extender of the finger tab of FIGS. 1 and 2.
Figure 8B:
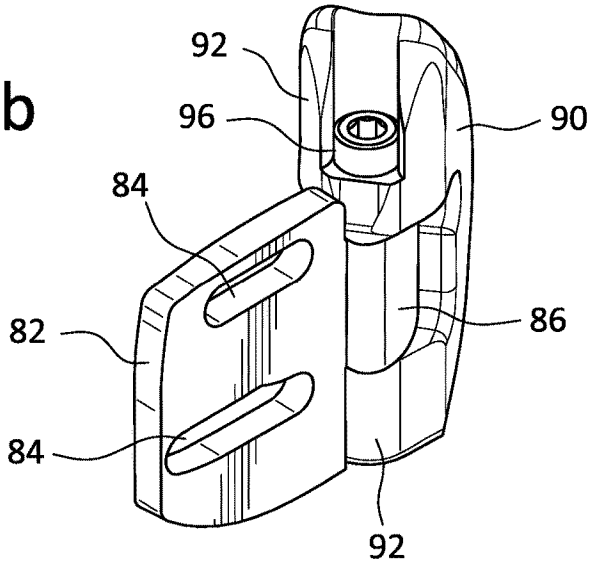
Figure 8A:
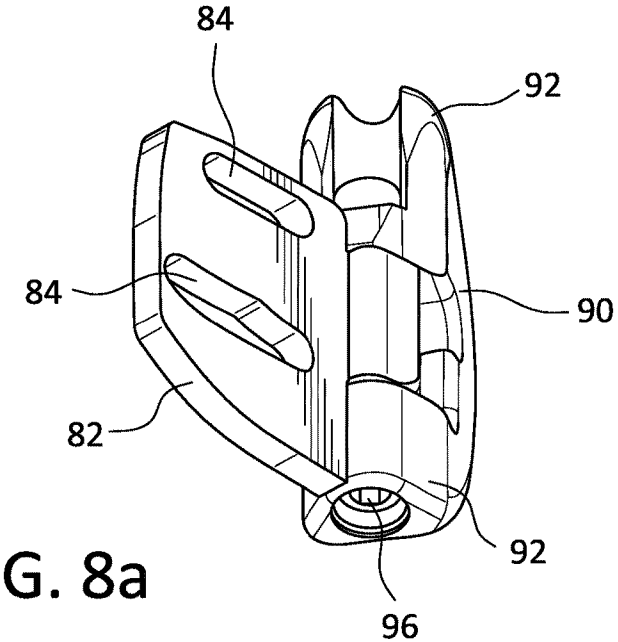

Referring now to FIGS. 8*a*-8*c*, there is shown a preferred embodiment of a palm extender 28. The palm extender is formed in two parts which are joined by a hinge connector. The first part is a generally planar fixture 82 which contains a pair of slots 84 which receive the screws 30, 32 to connect the fixture with the tab plate. Because the slots are elongated, the fixture can be displaced longitudinally relative to the tab plate to extend a selected distance from the rear edge of the tab plate. That is, when the screws 30, 32 are loosened, the fixture may be adjusted. Tightening of the screws 30, 32 secures the fixture in the selected position. At its remote end, i.e. the end away from the tab plate 4, the fixture includes a generally cylindrical extension 86 which contains a lateral through opening 88 having a threaded interior. A palm plate 90 is pivotally connected with the fixture 82 via the hinge connection. More particularly, the palm plate has a generally U-shaped configuration having generally cylindrical forward ends 92 each of which contains a through opening 94 which is aligned with the threaded through opening 88 of the fixture when the fixture extension 86 is arranged between the forward ends 92 of the palm plate 90. A pair of screws 96 pass through the through openings of the forward ends of the palm plate and are screwed into the threaded through opening 88 of the extension. Because the through openings 94 of the palm plate are not threaded, the palm plate is allowed to pivot like a hinge relative to the fixture. The freedom of movement of the palm plate relative to the fixture can be controlled by tightening or loosening the screws 96. If desired, the screws can be tightened sufficiently to lock the palm plate in a selected position relative to the fixture.

The pivotal palm plate extender 28 provides the archer adjustability to fit his or her hand while laying the fingers in a flat plane as taught by many recurve archer coaches. However, hands differ in size and shape. Longitudinal positioning of the extender adapts the finger tab of the invention to hands of different size. Some hand palm knuckle pads stick out which creates a need for the palm plate to swivel or pivot toward the deep cup portion of the hand until a touch or feel is achieved which allows the hand to be properly positioned for each shot.

Figure 9C:
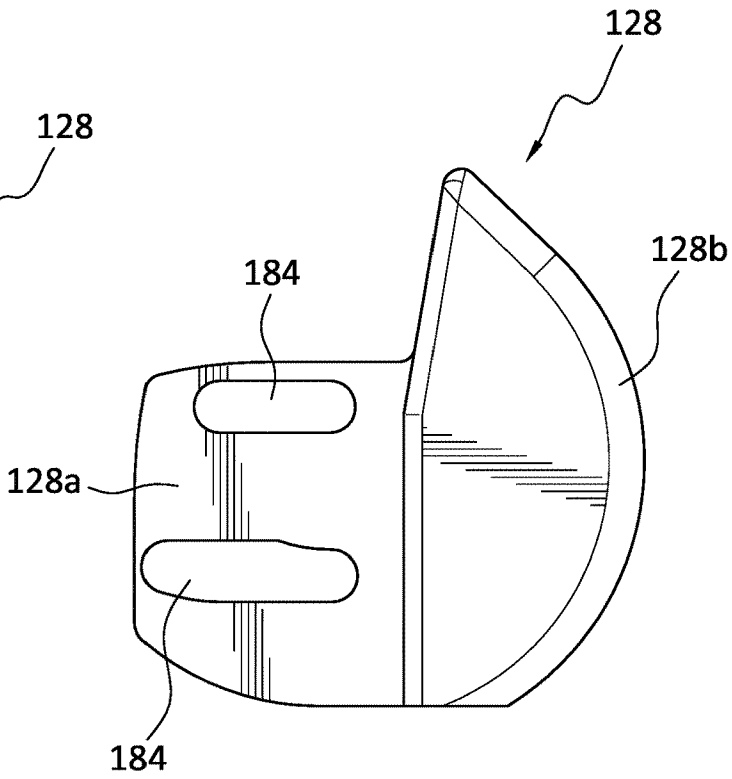
FIGS. 9*a*-9*c* are top, right side and bottom plan views of an alternate embodiment of a palm extender.
Figure 9B:
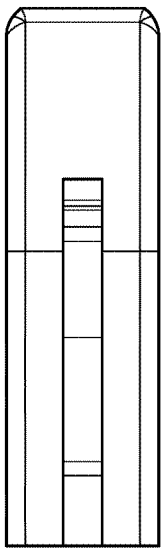
Figure 9A:
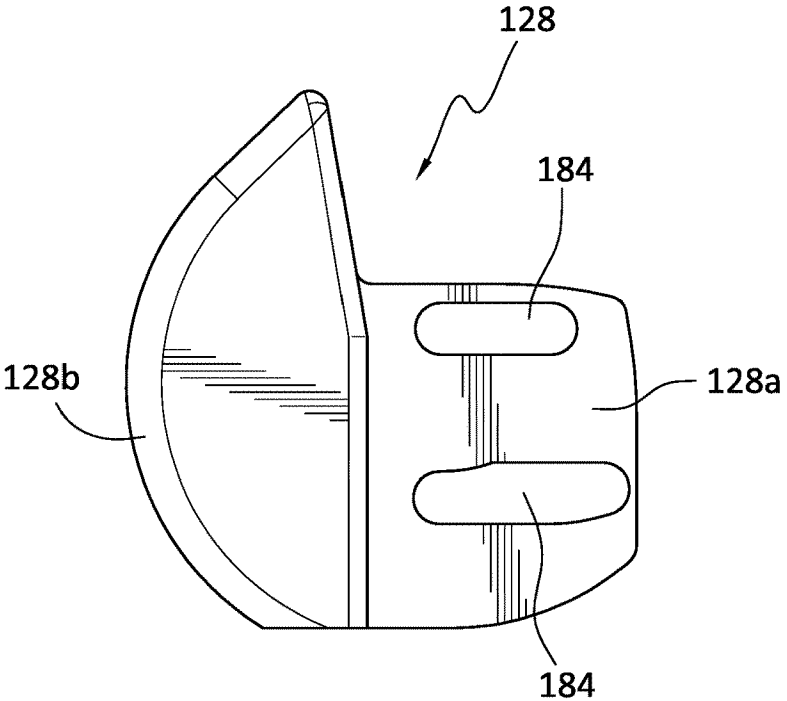

FIGS. 9*a*-9*c* show an alternative non-pivotal palm extender 128. It includes a first planar portion 128*a* which contains elongated through openings 184 which receive the screws 30, 32 for connecting the palm extender with the tab plate. The palm extender includes a second contoured portion 128*b* which is engaged by the palm of the archer to assist in positioning the archer's hand. The palm extender 128 is longitudinally adjustable relative to the tab plate by loosening and tightening the screws 30, 32 to position the extender in the same manner as the pivotal extender 28 of FIGS. 8*a*-8*c*.

The clamp 12, shelf 18, and extender 28; 128 are all formed of a rigid material such as metal. The spacer is also formed of a rigid material, but may be a material having a softer composition such as synthetic plastic or rubber. The screws are common machine screws which appropriately configured heads.

While the preferred forms and embodiments of the archery finger tab have been illustrated and described, it will be apparent to those of ordinary skill in the art that various changes and modifications may be made without deviating from the novel concepts thereof.

What is claimed is:

1. An archery finger tab, comprising a rigid ergonomic tab plate extending continuously in a plane and having upper and lower surfaces and front and rear edges, said upper surface containing at least one contour extending from said front edge toward said rear edge of said tab plate for receiving a finger of a pull hand of an archer, whereby said tab plate supports the archer's hand and finger during displacement of a string of an archery bow to fire a shot.

2. An archery finger tab as defined in claim 1, and wherein said tab plate upper surface contains a plurality of spaced parallel contours each of which extends from said front edge to a position intermediate of said rear edge of said tab plate.

3. An archery finger tab as defined in claim 2, and further comprising a spacer connected with said tab plate and extending upwardly from said tab plate upper surface, said spacer being arranged between a first contour and a second contour.

4. An archery finger tab as defined in claim 3, wherein said spacer is adjustably connected with said tab plate upper surface for longitudinal displacement relative thereto.

5. An archery finger tab as defined in claim 1, and further comprising a palm plate connected with said tab plate and extending from said tab plate rear edge.

6. An archery finger tab as defined in claim 5, wherein said palm plate is adjustably connected with said tab plate lower surface for longitudinal displacement relative to said tab plate to accommodate hands of different sizes.

7. An archery finger tab as defined in claim 6, wherein said palm plate includes a fixture adjustably connected with said tab plate lower surface and a palm portion pivotally connected with said fixture to fit the archer's hand relative to said tab plate.

8. An archery finger tab as defined in claim 5, wherein said palm plate is formed of a rigid material.

9. An archery finger tab as defined in claim 1, and further comprising at least one layer of flexible material connected with said tab plate and extending beyond said front edge, whereby said layer of material is arranged between the archer's finger and the string.

10. An archery plate as defined in claim 9, wherein a plurality of layers of material are connected with said tab plate.

11. An archery plate as defined in claim 10, wherein said layers of material include an outer leather layer, an intermediate rubber layer, and an inner suede layer.

12. An archery finger tab as defined in claim 1, and further comprising a shelf connected with said tab plate lower surface and extending beneath said plate along an edge normal to said front edge to define a surface against which a thumb of the archer may rest during firing of a shot.

13. An archery finger tab as defined in claim 1, wherein said tab plate is formed of brass.

14. A palm extender for an archery finger tab, comprising (a) a rigid tab plate;

(b) a rigid fixture arranged in a plane and connected with a rear portion of said rigid tab plate; and (c) a palm plate pivotally connected with said fixture via a hinge connection for movement beyond said plane containing said fixture to accommodate a palm portion of an archer's hand when firing an archery shot with the finger tab.

15. A palm extender as defined in claim 14, wherein said fixture includes a generally planar portion and an extension portion which contains a laterally extending through opening.

16. A palm extender as defined in claim 15, wherein said palm member has a generally U-shape configuration and has forward ends each containing a lateral through opening, said palm plate being configured to receive said extension portion of said fixture between said forward ends, with said end through openings being aligned with said extension through opening.

17. A palm extender as defined in claim 16, wherein said extension through opening is defined by a threaded inner surface, said hinge connection including a pair of screws which pass through said palm member end through openings, respectively, and into said extension threaded opening to pivotally connect said palm member with said fixture.

18. A palm extender as defined in claim 15, wherein said fixture planar portion contains at least one longitudinally extending through opening for receiving a screw connected with the tab plate, whereby said fixture is longitudinally adjustable relative to the tab plate.

19. An archery finger tab, comprising an ergonomic tab plate extending continuously in a plane and having an upper surface containing at least one contour extending from one edge toward an opposite edge of said tab plate for receiving a finger of a pull hand of an archer, whereby said tab plate supports the archer's hand and finger during displacement of a string of an archery bow to fire a shot.

* * * * *